United States Patent [19]

Cyron

[11] Patent Number: 4,832,998

[45] Date of Patent: May 23, 1989

[54] HONEYCOMB BODY, ESPECIALLY A CATALYST CARRIER BODY HAVING SHEET METAL LAYERS TWISTED IN OPPOSITE DIRECTIONS AND A METHOD FOR PRODUCING THE SAME

[75] Inventor: Theodor Cyron, Bergisch Gladbach, Fed. Rep. of Germany

[73] Assignee: Interatom GmbH, Bergisch Gladbach, Fed. Rep. of Germany

[21] Appl. No.: 48,361

[22] Filed: May 11, 1987

[30] Foreign Application Priority Data

May 12, 1986 [DE] Fed. Rep. of Germany ..... 3615902

[51] Int. Cl.[4] ..... B01J 35/02

[52] U.S. Cl. ..... 428/116; 428/34.1; 428/593

[58] Field of Search ..... 428/116, 35, 45, 54, 428/57, 59, 68, 73, 76

[56] References Cited

U.S. PATENT DOCUMENTS

| | | | |
|---|---|---|---|
| 3,890,108 | 6/1975 | Welsh | 428/116 X |
| 3,982,981 | 9/1976 | Takao et al. | 428/116 X |
| 4,014,968 | 3/1977 | Simon | 428/116 X |
| 4,186,172 | 1/1980 | Scholz . | |
| 4,256,172 | 3/1981 | Rahnke et al. | 428/116 X |
| 4,318,888 | 3/1982 | Chapman et al. . | |
| 4,598,063 | 7/1986 | Retallick | 428/116 X |
| 4,647,435 | 3/1987 | Nonnenmann . | |

FOREIGN PATENT DOCUMENTS

| | | |
|---|---|---|
| 0121174 | 3/1984 | European Pat. Off. . |
| 2727967 | 1/1979 | Fed. Rep. of Germany . |
| 3312944 | 10/1984 | Fed. Rep. of Germany . |
| 3341868 | 5/1985 | Fed. Rep. of Germany . |
| 2079174 | 1/1982 | United Kingdom . |

*Primary Examiner*—Nancy Swisher

*Attorney, Agent, or Firm*—Herbert L. Lerner; Laurence A. Greenberg

[57] ABSTRACT

A honeycomb body and a method of producing the body including a stack of structured metal sheets disposed in layers at least partially spaced apart from each other defining a multiplicity of channels through which gases can flow, the stack having ends twisted in mutually opposite directions about at least two fixation points, and a jacket tube surrounding the sheets and being formed of at least one segment, the sheets having ends joined with the jacket tube.

19 Claims, 6 Drawing Sheets

HONEYCOMB BODY, ESPECIALLY A CATALYST CARRIER BODY HAVING SHEET METAL LAYERS TWISTED IN OPPOSITE DIRECTIONS AND A METHOD FOR PRODUCING THE SAME

The invention relates to a honeycomb body, especially a catalyst carrier body, preferably used in motor vehicles, including structured metal sheets disposed in layers forming a multiplicity of channels through which gases can flow, the sheets being surrounded by a jacket tube optionally being formed of a plurality of segments and the sheets being joined to the jacket tube by a joining technique.

Honeycomb bodies of this kind which are used, for example, as catalyst carrier bodies and the problems of expansion and thermal stress arising with such a structure are described in European patent No. 0121174 and German Published, Non-Prosecuted Application DE-OS No. 33 12 944, for example. Various ways of overcoming the expansion problem are described for spirally wound layers of sheet metal brazed to one another.

It is accordingly an object of the invention to provide a honeycomb body, especially a catalyst carrier body, having sheet metal layers twisted or entwined in opposite directions and a method for producing the same, which overcomes the hereinafore-mentioned disadvantages of the heretofore-known methods and devices of this general type and which particularly overcomes the problems of expansion and temperature distribution by means of a suitable structure, so that the service life of such catalyst carrier bodies can be increased, even under extreme loads.

With the foregoing and other objects in view there is provided, in accordance with the invention, a honeycomb body, especially a catalyst carrier body, comprising a stack of structured metal sheets disposed in layers at least partially spaced apart from each other defining a multiplicity of channels through which gases can flow, the stack having ends twisted or entwined in mutually opposite directions about at least two fixation points, and a jacket tube surrounding the sheets and being formed of at least one segment, the sheets having ends joined with the jacket tube, such as by brazing or by a form-locking connection. A form-locking connection is one which is formed by the shape of the parts themselves, as opposed to a force-locking connection which requires force external to the parts being locked together.

Due to the twisted or entwined shape of the metal sheets and because they can be connected to the jacket tube at their ends by joining techniques such as brazing, a very stable structure is obtained, which however is highly elastic in the event of expansion.

In accordance with another feature of the invention, the jacket tube has a substantially round cross-section with a radius R, the fixation points are spaced apart, and the stack has a height h and a length L according to the following conditions:

(a) $h=2R/n$ and (b) $L=n/2\cdot R\cdot\pi$ where $n\geqq 2$ and need not be an integer and preferably $9\geqq n\geqq 3$.

The stack that is twisted or entwined to form the honeycomb body must have the same cross sectional area as the honeycomb body being formed. As a result, there is always one specific length for round cross-sectional shapes, depending on the height of the stack which is selected. In order to obtain particularly elastic shapes, the stack should preferably have a height of one-third to one-fifth, or even one-ninth, of the diameter of the honeycomb body to be produced. However, other height ratios are also easily attainable.

In accordance with a further feature of the invention, the jacket tube has an elongated cross section, and the fixation points are mutually offset with respect to the stack. Therefore, it is also possible to fill elongated round or polygonal cross sections of honeycomb bodies with structured metal sheets in a similar fashion. The difference in terms of production and in its later appearance is primarily in the disposition of the fixation points and possibly in the shape of the stack, as will be described in greater detail in conjunction with the drawings.

In accordance with an added feature of the invention, the structured sheets have end surfaces being brazed to one another at least in portions thereof, preferably in a narrow peripheral zone thereof. Since it cannot be assured in all cases that each individual ply is touching the jacket tube at both ends, it may be helpful for the structured sheets to be brazed to one another in a narrow peripheral zone, to assure reliable retention.

In accordance with an additional feature of the invention, the structured sheets are alternatingly disposed smooth and corrugated sheets. This is only one of many possible embodiments, since other known structures, such as double-corrugated structures or sheet metal plies having omega-shaped corrugations, may also be used.

In accordance with yet another feature of the invention, the smooth sheets are slightly longer than the corrugated sheets and protrude at both sides beyond the corrugated sheets by a slight given length. Naturally, layering a stack having such sheets entails more effort than if the sheets were all the same length, but it is easily accomplished. In order to form such a structure, it is substantially easier to connect the ends of all of the corrugated and smooth sheets to the jacket tube by a joining technique such as brazing, because ends of corrugated plies of metal sheets can no longer slide in between the jacket tube and the ends of the smooth plies of metal sheets.

In accordance with yet a further feature of the invention, the ends of the corrugated sheets have straight sections extending substantially centrally between adjacent smooth sheets. In this embodiment as well, the ends of all the sheet metal plies touch the jacket tube uniformly; in fact, they preferentially adapt to its contours, which facilitates making a firm connection.

In accordance with yet an added feature of the invention, the structured sheets are alternatingly disposed corrugated sheets having corrugations forming a given small angle with one another, some of the channels formed by the corrugated sheets intersecting one another at the given angle, which is preferably substantially between 5 degrees and 30 degrees. A configuration of this kind is known in principle for filters from European patent No. 0 025 584. The use of alternating corrugated sheets with corrugations that form a small angle with one another, provides various advantages. For example, a certain crosswise mixing among the individual exhaust gas channels and a slightly irregular end surface, which distributes the pressure loss that occurs there over a short length, are provided. Until now it was virtually impossible to provide this kind of structure for spirally wound catalyst carrier bodies, because it is extremely difficult to make a slanting corrugation. Intermeshing crimping rollers with slanted teeth in fact generally deform a strip of sheet metal very severely, so that relatively long lengths with a fine, uniform slanting corrugation are almost impossible to produce. In the present invention, however, only relatively short lengths are needed, which can even be produced by a single pair of crimping rollers. To this end, metal sheets of predetermined length need merely be introduced alternatingly into a sufficiently wide pair of crimping rollers, in a position that is slanted slightly to one side or the other and the sheets are then united in a stack again following the pair of crimping rollers. Otherwise there are practically no changes in the method of production as compared with that for differently structured metal sheets, because the very small angle between the corrugations has virtually no other effect on the handling thereof.

In accordance with yet an additional feature of the invention, the ends of the sheets are joined to the jacket tube by means of brazed seams extending substantially in circumferential direction, the brazed seams protruding inwardly and locking for increasing durability. The durability of these connections can be further increased by providing that the root of the weld is sunk inward somewhat, thereby additionally bringing about a form-locking connection between the jacket tube and the ends of the sheets.

In accordance with still another feature of the invention, the jacket tube has an oval or irregular cross section which cannot be completely filled with an oppositely twisted stack of sheets, and including filler pieces are integrated into the stack, the filler pieces being wound or layered from structured sheets. Cross-sectional shapes that cannot be completely filled with a oppositely-twisted stack of metal sheets may be needed for specific applications. Irregular cross-sectional shapes and in particular oval cross-sectional shapes, which have more favorable stability at a relatively high internal pressure, can still be produced according to the invention. The filler pieces fill out the remaining cross-sectional area and can in turn be wound or layered from structured metal sheets.

In accordance with still a further feature of the invention, the stack has a central region and end surfaces, and the sheets are pushed out toward one of the end surfaces in said central region, forming a quasi-round-conical end surface shape. Therefore, even a quasi-round-conical shape at the end surface (or a barrel or hemispherical shape) is attainable with the honeycomb bodies according to the invention. This kind of end surface shape is more favorable in some applications than a flat end surface, for reasons of fluidics. Although the shape resulting from telescopingly extending spirally wound catalyst carrier bodies cannot be attained exactly, still a similar effect can be attained, in fact all the more easily, as the height of the stack of sheets used to produce a honeycomb body of this kind becomes lower.

With the objects of the invention in view, there is also provided a method for producing a honeycomb body, especially a catalyst carrier body, which comprises layering a given number of structured metal sheets with ends into a stack; grasping fixation points in the stack with at least one fork-type tool and twisting or entwining the stack in opposite directions with the at least one fork-type tool; providing the twisted stack with a jacket tube by inserting the twisted stack into the jacket tube or by wrapping the twisted stack with a jacket tube; and joining the ends of the structured sheets to the jacket tube, such as by brazing or using a form-locking connection. This is particularly useful for the production of a honeycomb body having a round cross section.

In accordance with another mode of the invention, there is provided a method which comprises forming the stack with a substantially rectangular or parallelogram-shaped cross section, and placing the fixation points in a mutually offset position. This is particularly useful for a modified production method for elongated cross sections.

In accordance with a further mode of the invention, there is provided a method which comprises placing the at least one filler piece into the stack and preferably into a middle region of the stack. This is particularly useful for producing honeycomb bodies having an oval or irregular cross-sectional area. Except for the introduction of suitably shaped filler pieces into the stack of sheets serving as a starting material, the method is no different from those described above. In principle, it would also be possible to place the filler pieces into the jacket tube by using a suitable introducing device after the sheet metal stack has been twisted or entwined in opposite directions.

In accordance with an added mode of the invention, there is provided a method which comprises performing the step of joining the ends of the structured sheets to the jacket tube substantially in the middle of the jacket tube in the circumferential direction, in the event that the frictional forces that are already available are not adequate for the ensuing steps, pushing out a central region of the stack toward one end surface with a punch-type tool, and additionally joining the sheets with the jacket tube. The step of joining the ends of the structured sheets to the jacket tube may be performed with a brazed seam extending in the circumferential direction around the jacket tube. The step of additionally joining the sheets to the jacket tube may be performed by brazing. In this process although the individual sheets do turn about the sole fastening seam in the middle thereof if one is provided, they do not tear loose, so that considerable force can be exerted to attain the deformation. The result is an approximately round-conical, hemispherical or barrel-shaped end surface, and the individual channels no longer extend quite exactly in the axial direction of the catalyst carrier body, but this does not entail any disadvantages. The thus-deformed honeycomb body is secured to the jacket tube by a (further) joining technique such as brazing and/or form-locking connections of the sheets.

It should also be emphasized that in all of the catalyst carrier bodies produced according to the invention, both ends of each sheet metal ply in principle touch the jacket tube, thereby making it possible to connect each sheet metal ply to the jacket tube by welding or brazing at both ends.

The sheet metal plies no longer need necessarily be joined to one another, because as a result of the opposite winding thereof it is almost impossible to dislodge them from their position as long as they are firmly joined by brazing or welding over the entire length thereof, or at a plurality of points along their line of contact with the jacket.

In accordance with a concomitant mode of the invention, there is provided a method which comprises performing the step of joining the ends of the structured sheets to the jacket tube by providing the inside of the jacket tube with brazing material, and heating the jacket tube from the outside after providing the structured sheets with the jacket tube, such as by means of induction coils or infrared radiation. This provides further advantages in terms of production. For instance, only the inside of the jacket tube need be provided with brazing metal, for instance in the form of brazing powder, paste or foil, and in the brazing operation only the jacket tube need be heated up to the brazing temperature. While entire honeycomb structures are very difficult to heat, the jacket tube itself can be brought to brazing temperature much more easily, for example by induction coils or thermal radiation. This is another substantial advantage in terms of production, in addition to that of the greater elasticity of the honeycomb body according to the invention.

Other features which are considered as characteristic for the invention are set forth in the appended claims.

Although the invention is illustrated and described herein as embodied in a honeycomb body, especially a catalyst carrier body, having sheet metal layers twisted or entwined in opposite directions and a method for producing the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF DRAWINGS

Exemplary embodiments of the invention will be described in further detail below in conjunction with diagrammatic cross sections and end views of honeycomb bodies according to the invention. Shown are.

Figure 1:
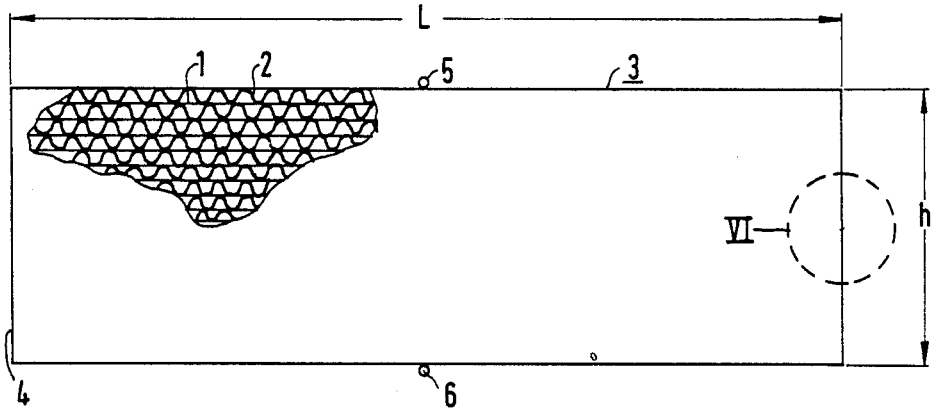
FIG. 1 is a diagrammatic, partially broken-away view of a stack of metal sheets at the beginning of the production process.
Figure 2:
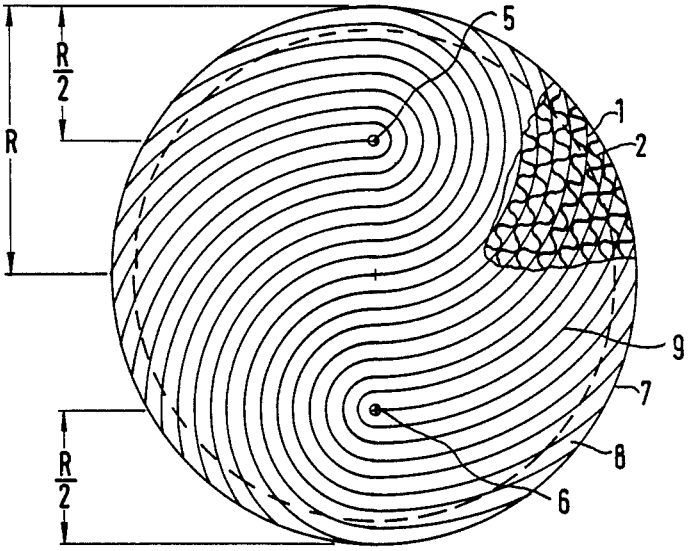
FIG. 2 is a partially broken-away end view of a catalyst carrier body produced from this stack by opposite or contrary entwining.

Referring now to the figures of the drawings in detail and first, particularly, to FIG. 1 thereof, there is seen a stack 3 having a height h and a length L, which is formed by layering alternating plies of smooth metal sheets 1 and corrugated or wavy metal sheets 2. Depending on the manufacturing method and on the desired cross section produced, the stack need not necessarily be layered at the outset into a cuboid with flat lateral surfaces 4. Other shapes, such as parallelograms or the like, may be more advantageous in the production process. Such a stack 3 is grasped at fixation points 5, 6 by a fork or similar fixation device and twisted or entwined in opposite directions by rotating the fork or bending over the ends of the stack. In this manner a shape like that diagrammatically shown in FIG. 2 is produced. Sheets twisted or entwined in this way can be secured by a joining technique such as brazing in a jacket tube or shell 7, producing an elastic yet stable catalyst carrier body. In principle, the jacket tube may also be formed of a plurality of segments, by way of example. In order to improve stability, the individual sheets 1, 2 may be brazed to one another at the end surfaces, preferably in an annular peripheral zone 8. In this manner, a stable structure is created even if individual plies should happen to not touch the jacket tube because of variations in length.

Figure 3:
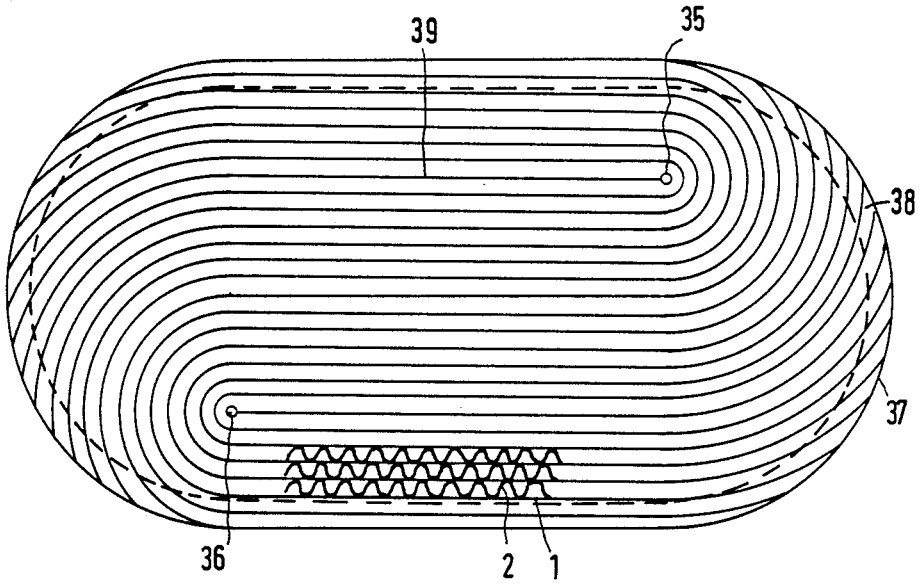
FIG. 3 is a diagrammatic end view of a catalyst carrier body with an elongated cross section.

In FIG. 3, a correspondingly produced catalyst carrier body can be made from a correspondingly longer stack of sheets 1, 2. It is only necessary for the fixation points 35, 36 to be offset from one another, which directly results in the desired cross sectional shape that fits into a corresponding jacket tube 37. Once again, the end surfaces may be brazed completely or in part, particularly in a peripheral zone 38.

Figure 4:
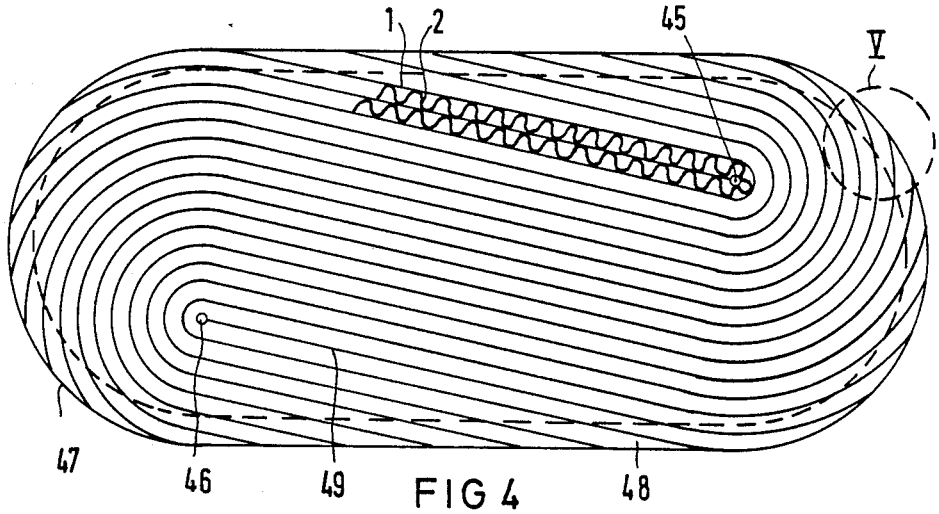
FIG. 4 is a view similar to FIG. 3 of another catalyst carrier body again having an elongated cross section but with diagonally extending twisted or entwined sheet metal layers.

Another configuration of the sheet plies 1, 2, which is even more favorable from the standpoint of elasticity and stability in an elongated cross section, is shown in FIG. 4. Once again this configuration can be produced from a stack of metal sheets analogously to the above-described methods by grasping them at fixation points 45, 46 offset from one another. The stack may optionally also have an approximately parallelogram-shaped cross section. In the embodiment shown in FIG. 4 as well, the individual plies need merely be connected at their ends by a joining technique such as brazing in the jacket tube 47. However, joining them at the end surface, in particular in a peripheral zone 48, is also possible.

It should be noted that in the illustrated embodiments of FIGS. 2, 3 and 4, in general smooth outer sheet plies 9, 39 or 49 of the initial stack are folded over against one another, so that this layer is formed of a double corrugated ply of sheet metal. Naturally, this can be avoided in principle by providing that the uppermost or lowermost sheet ply of the stack be cut off directly next to the fixation points. Such a provision is not highly significant, however, because the metal sheets are very thin in any case.

Figure 5:
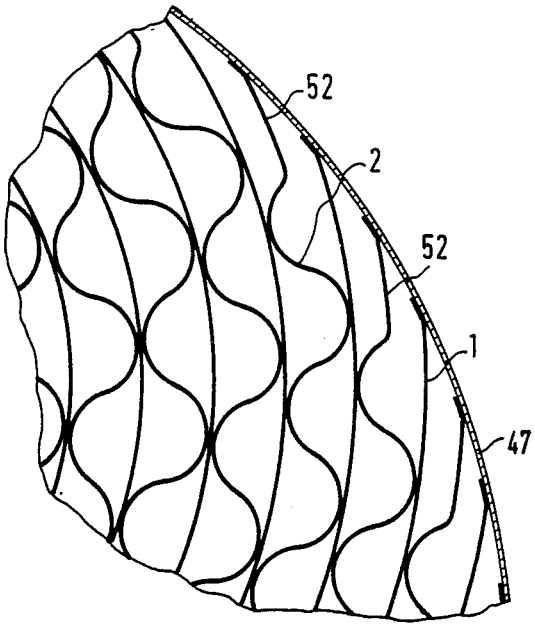
FIG. 5 is an enlarged fragmentary view of the portion V in the peripheral region of FIG. 4.

In FIG. 5, the portion V from the peripheral region of FIG. 4 is shown on a larger scale. In this illustrated embodiment, the corrugated sheets 2 have straight sections 52 at the ends thereof, which extend approximately centrally between the adjoining smooth sheets 1. As a result of this embodiment, the ends of all of the sheets have the same play available for touching the jacket tube, so that they adapt to it and a firm connection with the jacket tube in the presence of various angles of contact can be more easily accomplished.

Figure 6:
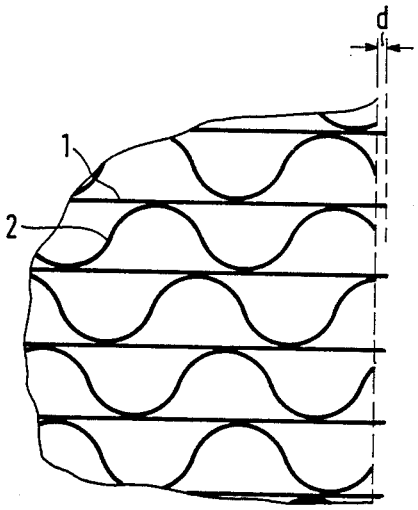
FIG. 6 is an enlarged fragmentary view of the portion VI in the peripheral region of FIG. 1.

The same result can be attained with an embodiment according to FIG. 6, which shows the portion VI from the peripheral region of FIG. 1. By shortening the corrugated sheet plies 2 relative to the smooth sheet plies 1 by a distance d, all of the ends of the sheet plies can again touch the jacket tube and adapt to it. In order to permit the production of a uniform stack from longer smooth sheets 1 and shorter corrugated sheets 2, it may be advantageous to provide the ends of the smooth sheets with grooves having a depth d, into which crosswise rods are inserted during stacking, so that the corrugated sheets 2 can assume their precise position between the crosswise rods.

Figure 7:
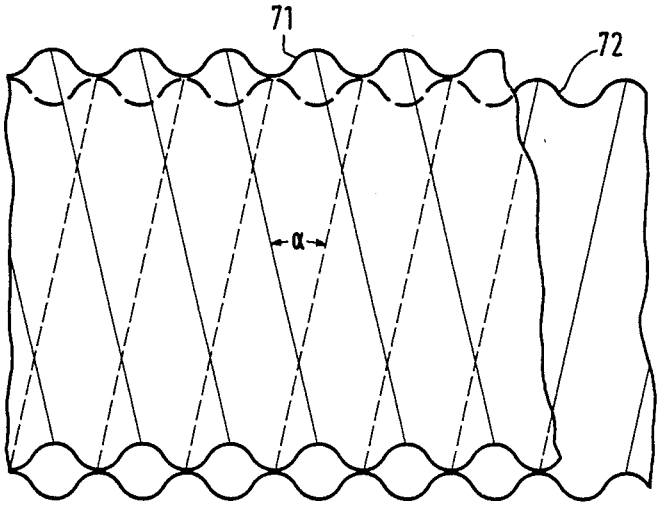
FIG. 7 is an enlarged fragmentary view of two sheet metal plies, the corrugations of which form a small angle with one another.

FIG. 7 shows an alternative structure for the sheet plies of the catalyst carrier body according to the invention. In the FIG. 7 embodiment, both sheet plies 71, 72 may have corrugations, which form a small angle $\alpha$ with one another. This embodiment has the advantage of requiring no smooth sheet plies as intermediate plies and additionally of causing the channels formed by the corrugations to intersect one another and communicate with one another, which makes the gases turbulent and thus leads to better contact with the surfaces.

Figure 8:
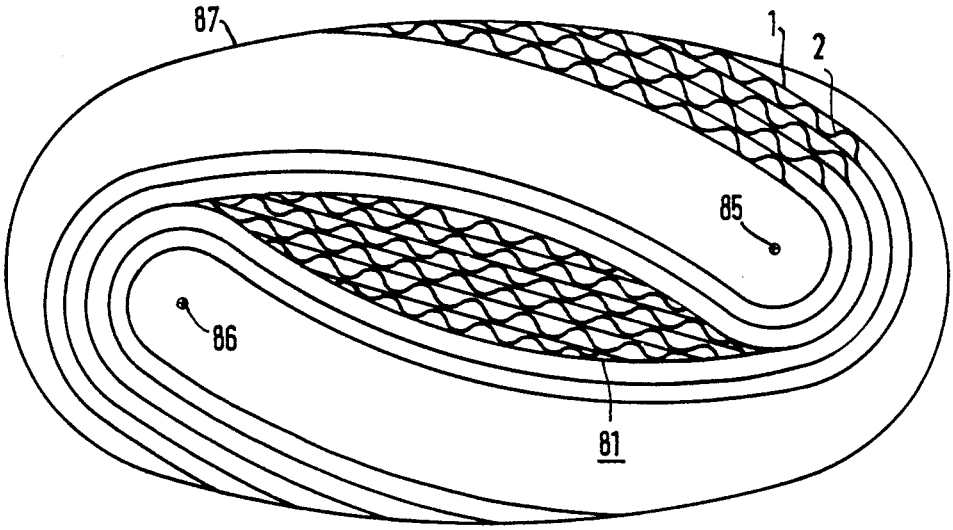
FIG. 8 is a diagrammatic end view of a catalyst carrier body with an oval cross section.
Figure 9:
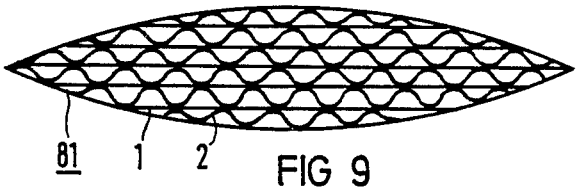
FIG. 9 is an end view of the filler piece 81 of FIG. 8.

FIG. 8 shows another embodiment of the invention, from which it is clear that oval or complicated cross sections can also be filled with sheet plies by using .the method according to the invention. Once again the catalyst carrier body basically is formed of an oppositely or contrarily twisted or entwined stack of smooth sheets 1 and corrugated sheets 2. The sheets are twisted or entwined about the fixation points 85, 86, analogously to the embodiment illustrated in FIG. 4. However, in order to enable the entire cross section to be filled up, a filler piece 81 which is additionally required, is inserted into the stack before or after the stack is twisted or entwined. Such a filler piece 81 must be pre-shaped in accordance with the cross-sectional area still to be filled and it can also be formed of structured sheets. In this manner, almost any cross section inside a jacket tube 87 can be filled.

Figure 10:
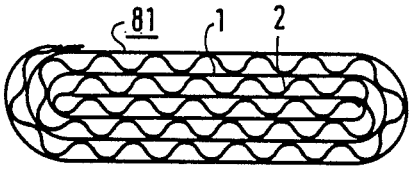
FIGS. 10, 11 and 12 are end views of alternative embodiments of the filler piece.
Figure 11:
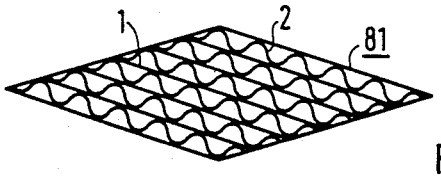
Figure 12:
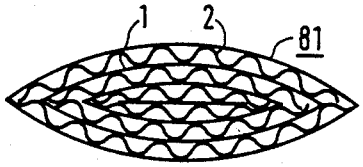

In FIGS. 9, 10, 11 and 12, suitable filler pieces are shown. The filler piece 81 is formed of layered smooth sheet metal strips 1 and corrugated sheet metal strips 2 which differ in length. In FIG. 10, the filler piece is produced from smooth sheet metal strips 1 and corrugated sheet metal strips 2 wound over one another in spiral fashion. FIGS. 11 and 12 show further variations that are suitable as filler pieces.

Figure 13:
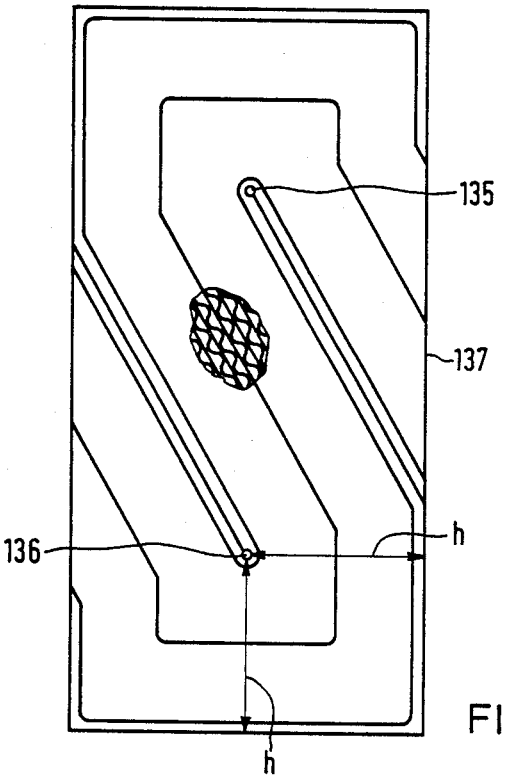
FIG. 13 is a diagrammatic end view of a catalyst carrier body with a rectangular cross section.

In FIG. 13 an end view of a honeycomb body of rectangular cross section is shown, as an example of the numerous cross sections that can be filled according to the present invention. Fixation points 135, 136 are again offset relative to the stack and have the same spacing h from their respective narrow ends as well as from both long or longitudinal sides. However, in order to produce such a cross section, a plurality of steps for deforming the stack are necessary before insertion into a jacket tube 137.

Catalyst carrier bodies constructed according to the invention are not vulnerable to alternating thermal stresses and therefore can have an increased service life even when installed near the engine.

I claim:

1. Honeycomb body, comprising a stack of structured metal sheets disposed in layers at least partially spaced apart from each other defining a multiplicity of channels through which gases can flow, said stack having ends twisted in mutually opposite directions about at least two fixation points, and a jacket tube surrounding said sheets and being formed of at least one segment, said sheets having ends joined with said jacket tube.

2. Honeycomb body according to claim 1, wherein said ends of said sheets are joined with said jacket tube by brazing.

3. Honeycomb body according to claim 1, wherein said jacket tube has a substantially round cross-section with a radius R, said fixation points are spaced apart, and said stack has a height h and a length L according to the following conditions:

(a) $h=2R/n$ and (b) $L=n/2\cdot R\cdot\pi$ where $n\geqq 2$ and need not be an integer.

4. Honeycomb body according to claim 1, wherein $9\geqq n\geqq 3$.

5. Honeycomb body according to claim 1, wherein said jacket tube has an elongated cross section, and said fixation points are mutually offset with respect to said stack.

6. Honeycomb body according to claim 1, wherein said structured sheets have end surfaces being brazed to one another at least in portions thereof.

7. Honeycomb body according to claim 1, wherein said structured sheets have end surfaces being brazed to one another at least in portions of a narrow peripheral zone thereof.

8. Honeycomb body according to claim 1, wherein said structured sheets are alternatingly disposed smooth and corrugated sheets.

9. Honeycomb body according to claim 8, wherein said smooth sheets are longer than said corrugated sheets and protrude at both sides beyond said corrugated sheets by a given length.

10. Honeycomb body according to claim 8, wherein said ends of said corrugated sheets have straight sections extending substantially centrally between adjacent smooth sheets.

11. Honeycomb body according to claim 1, wherein said structured sheets are alternatingly disposed corrugated sheets having corrugations forming a given angle with one another, some of said channels formed by the corrugated sheets intersecting one another at said given angle.

12. Honeycomb body according to claim 11, wherein said given angle is substantially between 5 degrees and 30 degrees.

13. Honeycomb body according to claim 1, wherein said ends of said sheets are joined to said jacket tube by means of brazed seams extending substantially in circumferential direction, said brazed seams protruding inwardly and locking for increasing durability.

14. Honeycomb body according to claim 1, wherein said jacket tube has an oval cross section which cannot be completely filled with an oppositely twisted stack of sheets, and including filler pieces are integrated into said stack, said filler pieces being wound or layered from structured sheets.

15. Honeycomb body according to claim 1, wherein said jacket tube has an irregular cross section which cannot be completely filled with an oppositely twisted stack of sheets, and including filler pieces are integrated into said stack, said filler pieces being wound or layered from structured sheets.

16. Honeycomb body according to claim 1, wherein said stack has a central region and end surfaces, and said sheets are pushed out toward one of said end surfaces in said central region, forming a quasi-round-conical end surface shape.

17. Honeycomb body according to claim 1, wherein said stack includes a multiplicity of said sheets, said layers of said sheets are substantially parallel, each of said sheets has two ends, and both of said ends of at least some of said sheets are joined to said jacket tube.

18. Honeycomb body according to claim 1, wherein said sheets have a substantially S-shaped cross section within said jacket tube.

19. Honeycomb body according to claim 17, wherein said sheets have a substantially S-shaped cross section within said jacket tube.

* * * * *